United States Patent [19]

Jackson et al.

[11] 4,220,208

[45] Sep. 2, 1980

[54] DRY PIPE FIRE EXTINGUISHING SPRINKLER SYSTEM

[75] Inventors: Jimmy Jackson, Macon; William D. Roquemore, Musella, both of Ga.

[73] Assignee: Hays Heating & Plumbing Company, Macon, Ga.

[21] Appl. No.: 853,798

[22] Filed: Nov. 21, 1977

[51] Int. Cl.[2] ..... A62C 37/06

[52] U.S. Cl. ..... 169/17; 169/37

[58] Field of Search ..... 169/16, 17, 37–42

[56] References Cited

U.S. PATENT DOCUMENTS

| | | | |
|---|---|---|---|
| 1,903,150 | 3/1933 | Tyden | 169/17 |
| 2,155,990 | 4/1939 | Hodgman, Jr. | 169/39 |
| 3,007,528 | 11/1961 | Gloeckler | 169/41 |
| 3,061,015 | 10/1962 | Cann, Jr. | 169/41 |
| 3,135,331 | 6/1964 | Lee | 169/17 |
| 3,584,689 | 6/1971 | Willms | 169/17 |
| 3,771,606 | 12/1973 | James | 169/37 |
| 3,810,511 | 5/1974 | James | 169/37 |
| 3,924,687 | 12/1975 | Gross | 169/19 |
| 4,007,877 | 2/1977 | Jackson et al. | 169/37 X |
| 4,007,878 | 2/1977 | Anderson | 169/37 X |

*Primary Examiner*—Johnny D. Cherry

*Attorney, Agent, or Firm*—Dowell & Dowell

[57] ABSTRACT

A dry pipe fire extinguishing sprinkler apparatus including an adapter which is charged with fluid under pressure and connects an adjustable drop nipple or branch pipe having a sprinkler to a header or supply pipe. The adapter includes a valve member which excludes water from the drop nipple and sprinkler until the fluid under pressure is discharged after which such valve member opens to discharge water through the sprinkler.

5 Claims, 4 Drawing Figures

DRY PIPE FIRE EXTINGUISHING SPRINKLER SYSTEM

BACKGROUND OF THE INVENTION

1. Field of the Invention

The present invention relates generally to automatically operated fire extinguishing systems used for buildings and relates specifically to fire extinguishing systems of the dry pipe type which normally exclude water from the sprinkler until a fire occurs in the vicinity of one or more sprinklers.

2. Description of the Prior Art

Heretofore many fire extinguishing sprinkler systems have been provided and such systems normally are either a wet pipe system or a dry pipe system with several variations and combinations being provided of these two basic systems. In each type of fire extinguishing system, a plurality of headers normally are provided which are connected to a water main or source of supply of water under pressure and each of such headers includes a plurality of drop nipples or branch pipes each of which has a sprinkler head at the end remote from the header. In wet pipe systems the headers and each of the nipples or branches normally are filled with water or other fire extinguishing medium and each of the sprinkler heads usually has a heat sensitive element which prevents the discharge of water from the system until after such element is activated to permit the water to be discharged through the sprinkler head. In dry pipe systems, the headers may or may not contain water or other fire extinguishing medium; however, in all cases the nipples or branch pipes are maintained in a dry state. This is done by means of a valve which ordinarily is located at the juncture between the branch pipes and the headers, and such valve normally is maintained in position either by an inert gas under pressure or by a mechanical linkage which is held in position by the heat sensitive element or a selectively operated holding member. When the heat sensitive element or holding member is activated, the valve is opened and water under pressure is permitted to flow through the drop nipples adjacent to the fire so that such water is discharged through the sprinkler head to extinguish the fire.

Since wet pipe systems normally are less complicated and are easier and more economical to install and maintain, they usually are preferred, but dry pipe systems are frequently desired or required. In areas where the ambient temperature reaches the point at which water freezes and the branch pipes and/or headers are exposed to such ambient temperature, it is necessary that the fire extinguishing system be of the dry pipe type. Otherwise the freezing of the water within the fire extinguishing system may cause the pipes to burst or at least block the flow of water in the event of a fire. If the headers are exposed to the ambient temperature, the supply of water is blocked by a selectively operated valve at a location which is not subject to freezing and the operation of such valve is controlled by heat sensing elements located adjacent to the sprinklers. When one or more of the sprinkler heat sensing elements is activated, the associated sprinkler is opened and simultaneously the selectively operated valve is opened to permit water to pass through the headers and the open sprinklers.

One of the inherent problems with substantially all sprinkler type fire extinguishing systems has been that the headers must be installed before the ceiling is completed. Normally, after the headers are installed, the drop nipples are attached to the headers and such drop nipples extend downwardly to a position below the proposed ceiling line so that the ceiling may be constructed around the drop nipples. After the ceiling has been finished, the drop nipples are individually marked, removed from the headers, cut off at the desired length, threaded to receive the sprinkler heads and then reinserted into the headers so that the sprinkler heads normally are located adjacent to the ceiling.

Some efforts have been made to provide a dry pipe fire extinguishing system having valves located adjacent to the juncture between the headers and the drop nipples and such valves have been maintained in position either by mechanical linkages in the form of a stem having its lower end resting on the fusible element or holding member, or by means of an inert gas which is introduced into the drop nipple under a pressure substantially higher than the pressure of the fire extinguishing medium in the header during use or during testing. Periodically all fire extinguishing systems are tested by introducing water or other medium into the headers under a pressure of at least 200 psig to make certain that the system functions properly when a fire occurs. During the test one or more sprinklers may be activated and after the test has been completed, the headers are drained (if the headers normally are dry) and the valve of the tested sprinkler is reset.

An example of a dry fire extinguishing system having a valve with a mechanical linkage is shown in U.S. Pat. No. 1,903,150 to Tyden and some examples of dry fire extinguishing systems in which the valve is held in position by gas under pressure are U.S. Pat. No. 3,135,331 to Lee; U.S. Pat. No. 3,584,689 to Willms; and U.S. Pat. No. 3,771,606 and U.S. Pat. No. 3,810,511 to James.

SUMMARY OF THE INVENTION

The present invention is embodied in a dry pipe fire extinguishing sprinkler system having one or more headers each of which is provided with a plurality of nipples or branch pipes. Each of such branch pipes includes a valve member located at the upper end at the juncture between the branch pipe and the header and such valve member is maintained in position by an inert noncondensing gas such as nitrogen or the like under a pressure of approximately 500 psig. The valve member includes a valve mounted on one end of a short stem which is slidably received within a guide or spider so that when the valve member is operated it will fall by gravity as well as by the pressure of the fire extinguishing medium in the header until the valve rests on the guide in a position where such valve does not restrict the flow of the fire extinguishing medium through the branch pipe. The valve member and the guide are mounted within an adapter interposed between the header and a drop nipple and preferably such drop nipple is adjustable in a manner similar to applicants' prior U.S. Pat. No. 4,007,877. When using an adjustable drop nipple, the dry pipe adapter may be installed after the ceiling has been finished and the length of the drop nipple can be adjusted so that the sprinkler head is located in a desired position.

It is an object of the invention to provide a dry pipe fire extinguishing system having at least one drop nipple connected to an adapter having a valve member which includes a valve that is maintained in cooperating relationship with a valve seat by an inert gas within the adapter and in which the valve is unseated and moved to a position where it does not interfere with the flow of fire extinguishing medium through the drop nipple when the system is activated.

Another object of the invention is to provide an adapter for a dry pipe fire extinguishing system in which the adapter connects an adjustable drop nipple having a sprinkler to a header and such adapter is provided with a valve which normally is held in position by an inert gas under pressure but which operates automatically when a heat sensitive element associated with the sprinkler on the lower end of the drop nipple is activated.

DESCRIPTION OF THE PREFERRED EMBODIMENT

Figure 1:
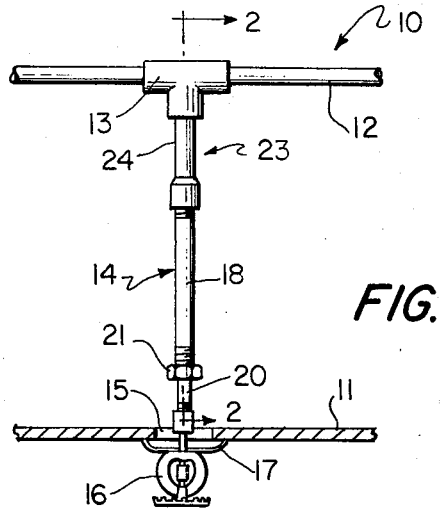
FIG. 1 is a side elevation illustrating one application of the invention.

With continued reference to the drawing, a dry pipe fire extinguishing system 10 is provided within a building which preferably has a ceiling 11. The fire extinguishing system normally includes one or more headers 12 located above the ceiling and each of such headers is provided with a plurality of T-couplings 13 which normally threadedly receive a branch pipe or drop nipple 14. The lower end of the drop nipple extends downwardly through an opening 15 in the ceiling 11 and terminates at a sprinkler 16. If desired an escutcheon plate 17 may be supported by the sprinkler in a position to cover the opening 15 and improve the appearance of the installation.

Preferably the drop nipple 14 is adjustable along its length so that the fire extinguishing system can be completed as soon as the ceiling is finished.

Figure 2:
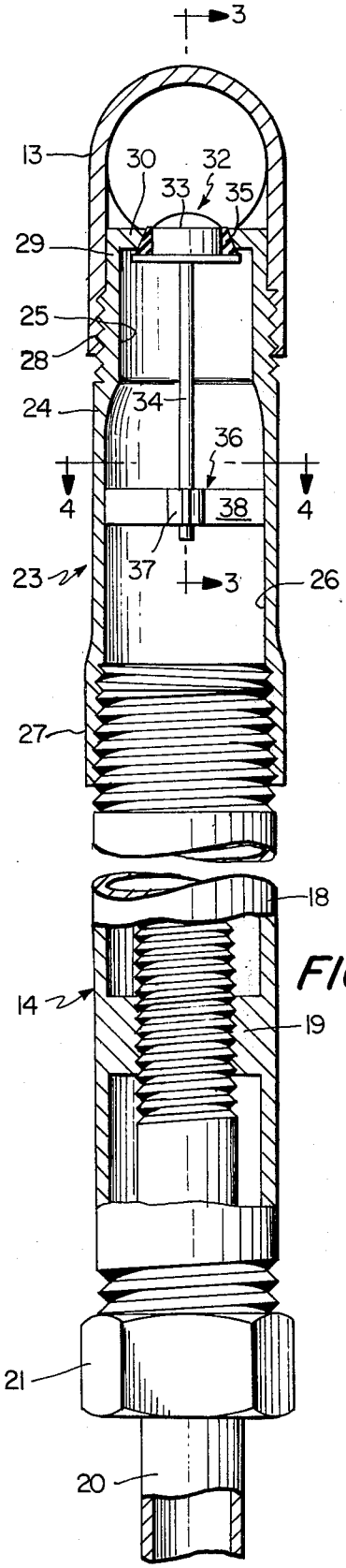
FIG. 2 is an enlarged fragmentary vertical section of the dry pipe adapter of FIG. 1.

As illustrated best in FIG. 2, the drop nipple 14 is made substantially in accordance with U.S. Pat. No. 4,007,877 and includes an elongated sleeve 18 having an internally threaded enlargement 19 located adjacent to the lower end. An externally threaded discharge pipe 20 threadedly engages the enlargement 19 so that rotation of the pipe 20 causes axial movement of such pipe relative to the sleeve 18. In order to provide a watertight connection between the discharge pipe 20 and the sleeve 18, the lower end of the sleeve is provided with a nut 21 which squeezes a compression packing (not shown) into intimate engagement with the discharge pipe to prevent the egress of water past such packing. With this construction, the upper end of the sleeve 18 may be connected to the T-coupling 13 with the sprinkler 16 located below the ceiling so that after the ceiling is finished the discharge pipe 20 may be rotated to cause the sprinkler 16 and the escutcheon plate 17 to move upwardly substantially into engagement with the ceiling.

In the present structure the upper end of the drop nipple 14 is threadedly received within an adapter 23 including a hollow generally tubular body 24 having a bore 25 at the upper end and a concentric counterbore 26 at the lower end. Such counterbore is provided with an internally threaded enlargement 27 which receives the upper threads of the drop nipple 14. The adapter 23 is provided with external threads 28 adjacent to the upper end which threadedly engages the T-coupling 13, and such adapter has an upwardly extending projection 29 located above the threads 28 which extends into the T-coupling 13. The body 24 includes an upper wall 30 having a valve seat 31 therein and such upper wall is positioned above the lowermost portions of the internal bore of the header 12 so that water cannot collect in the area of the adapter when the headers are drained after the fire extinguishing system has been tested or has been used.

In order to prevent the introduction of water or other fire extinguishing medium into the adapter 23 until the water is needed to extinguish a fire, a valve member 32 is located within the body 24 and such valve member includes a head 33 fixed to one end of a relatively short stem 34 having a length less than the length of the adapter 23. A valve 35 constructed of resilient material such as rubber, neoprene, plastic or the like, is mounted on the head 33 and normally engages the valve seat 31 in the upper wall 30 of the body. The stem 34 is slidably received within a guide or spider 36 having a tubular sleeve 37 connected to a plurality of outwardly extending arms 38, the outer ends of which engage the inner periphery of the counterbore 26. The internal diameter of the sleeve 37 is slightly larger than the stem 34 so that the stem can move freely through such sleeve by gravity until the head 33 engages and rests on the guide 36.

Figure 3:
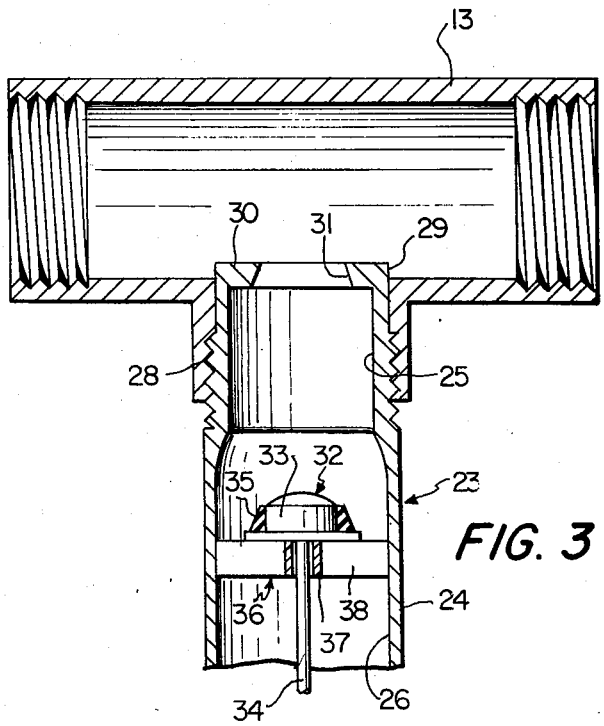
FIG. 3 is a section on the line 3—3 of FIG. 2.
Figure 4:
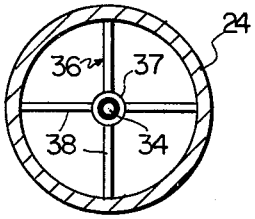
FIG. 4 is a section on the line 4—4 of FIG. 2.

With particular reference to FIGS. 2 and 3, it is desirable to permit as much water as possible to pass through the adapter in order to control a fire which has occurred in the area. Accordingly, the valve seat 31 in the upper wall 30 preferably has an opening with an area substantially equal to the area of the discharge pipe 20. However, the bore 25 is restricted in order to permit the adapter to be connected to the T-coupling 13 and this restricts the space between the head 33 of the valve member and the bore 25 of the adapter. By placing the guide or spider 36 in the counterbore 26, the head 33 of the valve member moves out of the bore into the larger counterbore when the valve member is operated so that the cross-sectional area between the head 33 and the counterbore 26 is at least as great as the cross-sectional area of the valve seat 31 so that such head does not restrict the flow of water past the same.

Normally the adapter 25 and the drop nipple 14 are filled with an inert non-condensable gas such as nitrogen or the like under a pressure of approximately 500 psig to force the valve 35 into intimate engagement with the valve seat 31.

In the operation of the device, the drop nipple 14 and the adapter 23 are joined together in assembled relationship with the lower end of the drop nipple being closed and sealed by a heat fusible element forming part of the sprinkler 16. An inert gas under pressure is introduced into the drop nipple and adapter assembly to force the valve member 32 against the valve seat 31 and seal the upper end of such assembly. The upper end of the adapter 23 then is inserted into one of the T-couplings 13 of the header 12 and is screwed into such T-coupling until the upper wall 30 of the adapter body is located above the lower portion of the header 12. Thereafter the discharge pipe 20 is screwed into the sleeve 18 until the sprinkler 16 and the escutcheon plate 17 are located in a desired position.

If a fire should occur in the vicinity of the sprinkler 16, the heat sensing element is activated to remove the seal from the lower end of the drop nipple 14 permitting the inert gas to escape so that the valve member 32 can fall by gravity until the head 33 rests on the guide 36.

If the header 12 is not exposed to freezing temperatures, such header may be filled with water at all times so that such water is instantly discharged through the adapter 23, the drop nipple 14 and the sprinkler 16 to extinguish the fire. If there is a possibility that the header 12 will be subjected to freezing temperatures, water may be excluded from the header by a remotely controlled valve (not shown) which is operated by a remote heat sensing element which opens the remotely controlled valve and permits water under pressure to enter the headers when a fire occurs.

We claim:

1. In a dry pipe fire extinguishing system having at least one header, a drop nipple and at least one connection having a bore in open communication with a header, the improvement comprising an adapter having a hollow body for connecting the drop nipple to said connection, means for attaching said body to said connection, said body having a projection extending into said connection and including an upper wall having a valve seat means defining an opening, said wall being located above the lowermost portion of the bore of said connection, means for connecting the drop nipple to said body remote from said wall, valve means located within said body, said valve means being mounted on one end of a stem in a position to cooperatively engage and entirely fill said valve seat means, said stem having a length which is less than the length of said adapter body, a portion of said valve means extending above said wall when said valve means engages said valve seat means, guide means positioned within said adapter body remote from said valve seat means and having an opening for slidably receiving and guiding said stem, and fluid means for normally urging said valve means into intimate sealing engagement with said valve seat means to prevent the introduction of fire extinguishing medium into said drop nipple.

2. The structure of claim 1 in which said valve seat means is positioned substantially in alignment with the header.

3. The structure of claim 1 in which the cross-sectional area of said valve seat means is substantially the same as the cross-sectional area of the drop nipple.

4. The structure of claim 1 in which said fluid means for urging said valve means into engagement with said valve seat means includes gas under pressure.

5. In a dry pipe fire extinguishing system having at least one header with at least one connection having a bore in open communication with a header, the combination comprising an adjustable drop nipple and an adapter, said drop nipple including an elongated sleeve having internal threads therein, a discharge pipe having external threads cooperatively engaging the internal threads of said sleeve for axial adjustment relative to said sleeve, sprinkler means mounted on the end of said discharge pipe remote from said sleeve, means for sealing said discharge pipe adjacent to said sprinkler, said adapter including a hollow elongated tubular body having a wall at one end, means for attaching said body to the connection of the header so that said wall is positioned above the lowermost portion of the bore of said connection, means for connecting said drop nipple sleeve to said adapter body in a position remote from said wall, said wall having a valve seat defining an opening, a valve member located within said body and including a stem having a length less than the length of said body, said valve member being positioned to cooperatively engage and entirely fill said valve seat, guide means positioned within said body remote from said wall, said guide means including a guide sleeve which slidably receives the stem of said valve member, a plurality of arm means connecting said guide sleeve to said adapter body so that said guide sleeve is in axial alignment with said valve seat, and means for normally urging said valve member into intimate sealing engagement with said valve seat to prevent the introduction of fire extinguishing medium into said body until said means for sealing said discharge pipe is opened.

* * * * *